US007370393B2

(12) United States Patent
Hlavaty et al.

(10) Patent No.: US 7,370,393 B2
(45) Date of Patent: May 13, 2008

(54) SEAT BELT BUCKLE FOR USE WITH PRETENSIONER

(75) Inventors: David G. Hlavaty, Northville Township, MI (US); James L. Webber, Shelby Township, MI (US); Michael Todd Moury, Shelby Township, MI (US)

(73) Assignee: Delphi Technologies, Inc., Troy, MI (US)

( * ) Notice: Subject to any disclaimer, the term of this patent is extended or adjusted under 35 U.S.C. 154(b) by 132 days.

(21) Appl. No.: 10/945,308

(22) Filed: Sep. 20, 2004

(65) Prior Publication Data

US 2006/0059667 A1 Mar. 23, 2006

(51) Int. Cl.
*A44B 11/25* (2006.01)
*A44B 11/26* (2006.01)

(52) U.S. Cl. ..... 24/633; 24/641

(58) Field of Classification Search ..... 24/633–642; 280/801.1, 806; 297/468, 378.13
See application file for complete search history.

(56) References Cited

U.S. PATENT DOCUMENTS

| | | | | |
|---|---|---|---|---|
| 2,863,200 | A | 12/1958 | Miller et al. | |
| 3,698,657 | A | 10/1972 | Kirchhoff | 242/107.4 |
| RE29,342 | E | 8/1977 | Barbe | 24/230 |
| 4,151,967 | A | 5/1979 | Lindblad | 242/107.4 |
| 4,358,878 | A | 11/1982 | Seel | 24/230 |
| 4,454,634 | A | 6/1984 | Haglund et al. | 24/636 |
| 4,705,296 | A | 11/1987 | Andersson et al. | 280/806 |
| 4,870,726 | A | 10/1989 | Eksell et al. | 24/636 |
| 4,972,559 | A | 11/1990 | Haglund | 24/637 |
| 5,008,989 | A | 4/1991 | Wedler et al. | 24/641 |
| 5,029,369 | A | 7/1991 | Oberhardt et al. | 24/633 |
| 5,054,171 | A | 10/1991 | Tanaka | 24/637 |
| 5,066,042 | A | 11/1991 | Fohl | 280/806 |
| 5,097,571 | A | 3/1992 | Fohl | 24/641 |
| 5,115,543 | A | 5/1992 | Fohl | 24/633 |
| 5,119,532 | A | 6/1992 | Tanaka | 24/641 |
| 5,133,115 | A | 7/1992 | Bock | 24/633 |
| 5,142,749 | A | 9/1992 | Biller | 24/636 |
| 5,159,732 | A | 11/1992 | Burke | 24/641 |
| 5,195,224 | A | 3/1993 | Bock et al. | 24/641 |
| 5,211,447 | A | 5/1993 | Sedlmayr et al. | 297/468 |
| 5,213,365 | A | 5/1993 | Fohl | 280/806 |
| 5,216,788 | A | 6/1993 | Bock | 24/633 |
| 5,280,669 | A | 1/1994 | Nanbu et al. | 24/641 |
| 5,309,611 | A | 5/1994 | Wier et al. | 24/633 |
| 5,341,546 | A | 8/1994 | Burke | 24/641 |
| 5,357,658 | A | 10/1994 | Tanaka | 24/641 |

(Continued)

FOREIGN PATENT DOCUMENTS

| | | |
|---|---|---|
| DE | G 92 02 525.0 | 5/1992 |

(Continued)

*Primary Examiner*—Robert J. Sandy
*Assistant Examiner*—Ruth C. Rodriguez
(74) *Attorney, Agent, or Firm*—Douglas D. Fekete

(57) ABSTRACT

A seat belt buckle for use with a tongue of a seat belt includes a latch that engages the tongue, and a release bar that releases the latch. An inertia locking device mounted to a frame portion is normally biased in an unlocking position and rotates to a locking position to prevent movement of the release bar into the release position when the seat belt buckle is subjected to a force greater than the biasing force.

34 Claims, 10 Drawing Sheets

U.S. PATENT DOCUMENTS

| | | | | |
|---|---|---|---|---|
| 5,369,855 | A | 12/1994 | Tokugawa | 24/641 |
| 5,373,612 | A | 12/1994 | Kopetzky | 24/637 |
| 5,496,068 | A | 3/1996 | Ball et al. | 280/806 |
| 5,522,619 | A | 6/1996 | Collins | 280/806 |
| 5,555,609 | A | 9/1996 | Tolfsen et al. | 24/641 |
| 5,566,431 | A | 10/1996 | Haglund | 24/633 |
| 5,595,400 | A | 1/1997 | Wier | 280/806 |
| 5,596,795 | A | 1/1997 | Beisswenger | 24/633 |
| 5,649,341 | A | 7/1997 | Ashline et al. | 24/171 |
| 5,704,099 | A | 1/1998 | Cahill | 24/633 |
| 5,742,987 | A | 4/1998 | Mikulec et al. | 24/641 |
| 5,765,266 | A | 6/1998 | Betz | 24/633 |
| 5,781,971 | A | 7/1998 | Petersen | 24/633 |
| 5,839,174 | A | 11/1998 | Chamings et al. | 24/633 |
| 5,974,638 | A | 11/1999 | Yamaguchi et al. | 24/633 |
| 5,996,193 | A | 12/1999 | Gill et al. | 24/641 |
| 6,170,134 | B1 | 1/2001 | Downie et al. | 24/641 |
| 6,205,628 | B1 | 3/2001 | Downie | 24/633 |
| 6,233,794 | B1 | 5/2001 | Kohlndorfer et al. | 24/641 |
| 6,266,855 | B1 | 7/2001 | Specht et al. | 24/633 |
| 6,340,176 | B1 | 1/2002 | Webber et al. | 280/806 |
| 6,367,129 | B1 | 4/2002 | Mori | 24/641 |
| 6,370,742 | B1 | 4/2002 | Yamaguchi et al. | 24/641 |
| 6,438,810 | B2 | 8/2002 | Rogers, Jr. et al. | 24/641 |
| 6,513,747 | B1 | 2/2003 | Lee et al. | 242/374 |
| 6,539,595 | B1 | 4/2003 | Benedict | 24/633 |
| 6,550,112 | B2 | 4/2003 | Rohrle et al. | 24/641 |
| 6,550,867 | B2 | 4/2003 | Rogers, Jr. et al. | 297/468 |
| 6,572,147 | B2 | 6/2003 | Webber et al. | 280/806 |
| 6,588,077 | B2 | 7/2003 | Katsuyama et al. | 24/641 |
| 6,701,587 | B1 | 3/2004 | Sato et al. | 24/633 |
| 6,725,509 | B1 | 4/2004 | Lee et al. | 24/641 |
| 7,124,481 | B2 * | 10/2006 | Sato et al. | 24/641 |

FOREIGN PATENT DOCUMENTS

| | | | | |
|---|---|---|---|---|
| DE | G 92 02 526.9 | | 5/1992 | |
| EP | 0 231 336 | B1 | 12/1987 | |
| EP | 0 368 277 | | 5/1990 | |
| EP | 0 384 703 | | 8/1990 | |
| EP | 0 557 983 | B1 | 5/1996 | |
| GB | 2 227 513 | A | 8/1990 | |
| GB | 2 249 806 | A | 5/1992 | |
| JP | 03-208752 | * | 9/1991 | 280/806 |
| WO | WO 87/00736 | | 2/1987 | |
| WO | WO 90/10397 | | 9/1990 | |

* cited by examiner

SEAT BELT BUCKLE FOR USE WITH PRETENSIONER

TECHNICAL FIELD

This present invention relates generally to a seat belt buckle and more specifically, the present invention relates to a seat belt buckle for use with a seat belt pretensioner.

BACKGROUND

Seat belt buckles in general must meet many requirements to reliably operate under any and all conditions. One specific requirement for seat belt buckles is to function when used with seat belt pretensioners (i.e., retractor, buckle or anchor pretensioners).

Seat belt pretensioners remove seat belt slack in the event of a predetermined occurrence. When pretensioners are activated this results in a very high acceleration of the seat belt webbing and subsequently the seat belt buckle.

Therefore, it is desirable to provide the seat belt buckle with a locking feature or device that is engaged during activation of the pretensioners.

SUMMARY

Disclosed herein is a seat belt buckle for use with a tongue of a seat belt. The seat belt buckle of the exemplary embodiment comprises: a frame portion; a latch being movably mounted to the frame portion for movement between a first position and a second position, the latch being configured to engage a portion of the tongue as the latch moves from the first position to the second position; a release bar being slidably mounted to the frame portion for movement between a locking position and a release position, wherein movement toward the release position causes an opening force to be applied to the latch in order to move the latch from the second position towards the first position; and an inertia locking device rotatably mounted to the frame portion for movement between a locking position and an unlocking position, wherein the inertia locking device prevents movement of the release bar into the release position when the inertia locking device is in the locking position, the inertia locking device being biased into the unlocking position by a biasing force and the inertia locking device rotates into the locking position when the seat belt buckle is subjected to a force that creates a moment in the locking device that is greater than the biasing force.

In another exemplary embodiment, a method for limiting the acceleration forces applied to an inertia locking device of a seat belt buckle is disclosed. The method comprising: rotatably mounting an inertia locking device to a frame portion of the seat belt buckle, wherein the inertia locking device comprises: a pendulum having a pair of arms extending away from a point of rotatable securement of the inertia locking device to the frame portion; a mass mounted to one of the pair of arms; a contact point disposed at the other one of the pair of arms, the contact point being configured to engage a contact member of a release bar of the seat belt buckle when the inertia locking device is rotated to a locking position; a spring for biasing the inertia locking device into an unlocking position; a mounting portion secured to the pair of arms, the mounting portion being rotatably received around a pivot pin secured to the frame portion, wherein the mounting portion is perpendicular to the frame portion and the pair of arms are perpendicular to the mounting portion and the center of gravity of the one of the pair of arms with the mass is aligned with an axis perpendicular to the mounting portion and is parallel to a portion of the frame portion the mounting portion is mounted to.

Also disclosed herein is a restraint system for a vehicle. The restraint systems comprising: a seat belt buckle for use with a tongue of a seat belt, wherein the seat belt buckle comprises: a frame portion; a latch being movably mounted to the frame portion for movement between a first position and a second position, the latch being configured to engage a portion of the tongue as the latch moves from the first position to the second position; a release bar being slidably mounted to the frame portion for movement between a locking position and a release position, wherein movement toward the release position causes an opening force to be applied to the latch in order to move the latch from the second position towards the first position; and an inertia locking device rotatably mounted to the frame portion for movement between a locking position and an unlocking position, wherein the inertia locking device prevents movement of the release bar into the release position when the inertia locking device is in the locking position, the inertia locking device being biased into the unlocking position by a biasing force and the inertia locking device rotates into the locking position when the seat belt buckle is subjected to a force that creates a moment in the locking device that is greater than the biasing force; and a pre-tensioning device for removing slack from the seat belt in accordance with a predetermined event.

In another exemplary embodiment, a locking mechanism for use with a seat belt having a tongue member configured for latching with the seat belt buckle is disclosed. The locking mechanism comprises: a frame portion; a latch being movably mounted to the frame portion for movement between a first position and a second position, the latch being configured to engage a portion of the tongue member as the latch moves from the first position to the second position; a release bar being slidably mounted to the frame portion for movement between a locking position and a release position, wherein movement toward the release position causes an opening force to be applied to the latch in order to move the latch from the second position towards the first position; and an inertia locking device rotatably mounted to the frame portion for movement between a locking position and an unlocking position, wherein the inertia locking device prevents movement of the release bar into the release position when the inertia locking device is in the locking position, the inertia locking device being biased into the unlocking position by a biasing force and the inertia locking device rotates into the locking position when the seat belt buckle is subjected to a force that creates a moment in the locking device that is greater than the biasing force.

The above-described and other features of the present disclosure will be appreciated and understood by those skilled in the art from the following detailed description, drawings, and appended claims.

DRAWINGS

DESCRIPTION OF EXEMPLARY EMBODIMENTS

Disclosed herein is a seat belt buckle for use with a pre-tensioning device, which upon activation removes the slack from a seat belt, configured to be latched to the seat belt buckle.

The seat belt buckle comprises a latch for securing a tongue of the seat belt to the seat belt buckle. The seat belt buckle further comprises a release button that actuates a release bar slidably mounted to a frame portion of the seat belt buckle. The release button is configured to slide the release bar from a locking position to a release position, wherein movement from the locking position to the release position causes an opening force to be applied to the latch in order to move the latch from a locking position towards an open position wherein the tongue portion of the seat belt is able to be removed from the seat belt buckle.

The seat belt buckle further comprises an inertia locking device or movable locking member rotatably mounted to the frame portion for movement between a locking position and an unlocking position, wherein the inertia locking device prevents movement of the release bar into the release position when the inertia locking device is in the locking position. The inertia locking device is biased into the unlocking position by a biasing force such that the inertia locking device only rotates into the locking position when the seat belt buckle is subjected to a force that creates a moment in the locking device that is greater than the biasing force. The inertia locking device is also configured to be forced back into the unlocking position when the seat belt buckle is no longer subjected to the force that creates the moment in the locking device. Thus, in the event of the failure of the item creating the biasing force upon the inertia locking device the same is able to be rotated back into its unlocking position when the seat belt is no longer subjected to the force, which creates a moment in the locking device. Moreover, the inertia locking device is configured to be affected or rotate in response to accelerations in one of three axes or directions.

Figure 1:
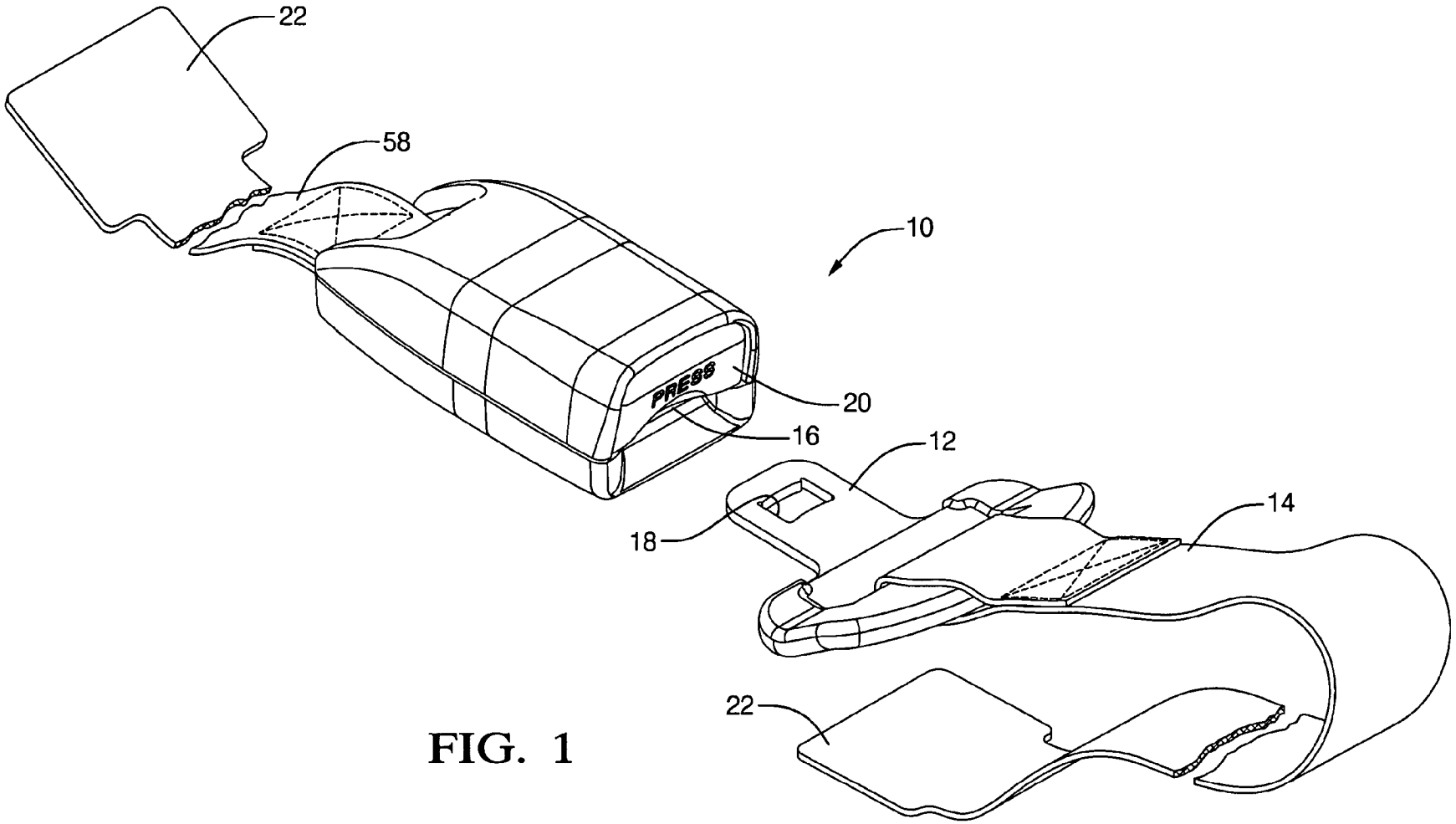
FIG. 1 is a perspective view of a seat belt buckle constructed in accordance with exemplary embodiments of the present invention.

Referring now to FIG. 1, a seat belt buckle 10 constructed in accordance with an exemplary embodiment of the present invention is illustrated. Seat belt buckle 10 is configured to receive and engage a tongue portion 12 of a seat belt 14. The tongue portion 12 is received within an opening 16 of seat belt buckle 10. Upon insertion of tongue portion 12 into opening 16, a latching mechanism engages an opening 18 of tongue portion 12. In order to release the tongue portion from seat belt buckle 10, a release button 20 is depressed and tongue portion 12 is ejected from seat belt buckle 10.

Seat belt buckle 10 is also secured to a pre-tensioning mechanism 22 (illustrated schematically by box 22), which in accordance with a predetermined activation event will cause the pre-tensioning mechanism to remove the slack from the seat belt webbing. As illustrated, the pre-tensioning mechanism may be secured to either the seat belt webbing of the tongue portion or the webbing securing the belt buckle to the vehicle or both. Examples of pretensioning mechanisms (e.g., retractors and pretensioners for seat belt buckles, seat belts and seat belt anchors) are found in the following U.S. Pat. Nos. 6,340,176; 6,513,747; 6,550,867; and 6,572,147 the contents of which are incorporated herein by reference thereto. U.S. Pat. No. 6,725,509, also incorporated herein by reference thereto, illustrates a seat belt buckle. U.S. Pat. No. 6,438,810 also incorporated herein by reference thereto, illustrates a seat restraint buckle assembly.

Figure 2:
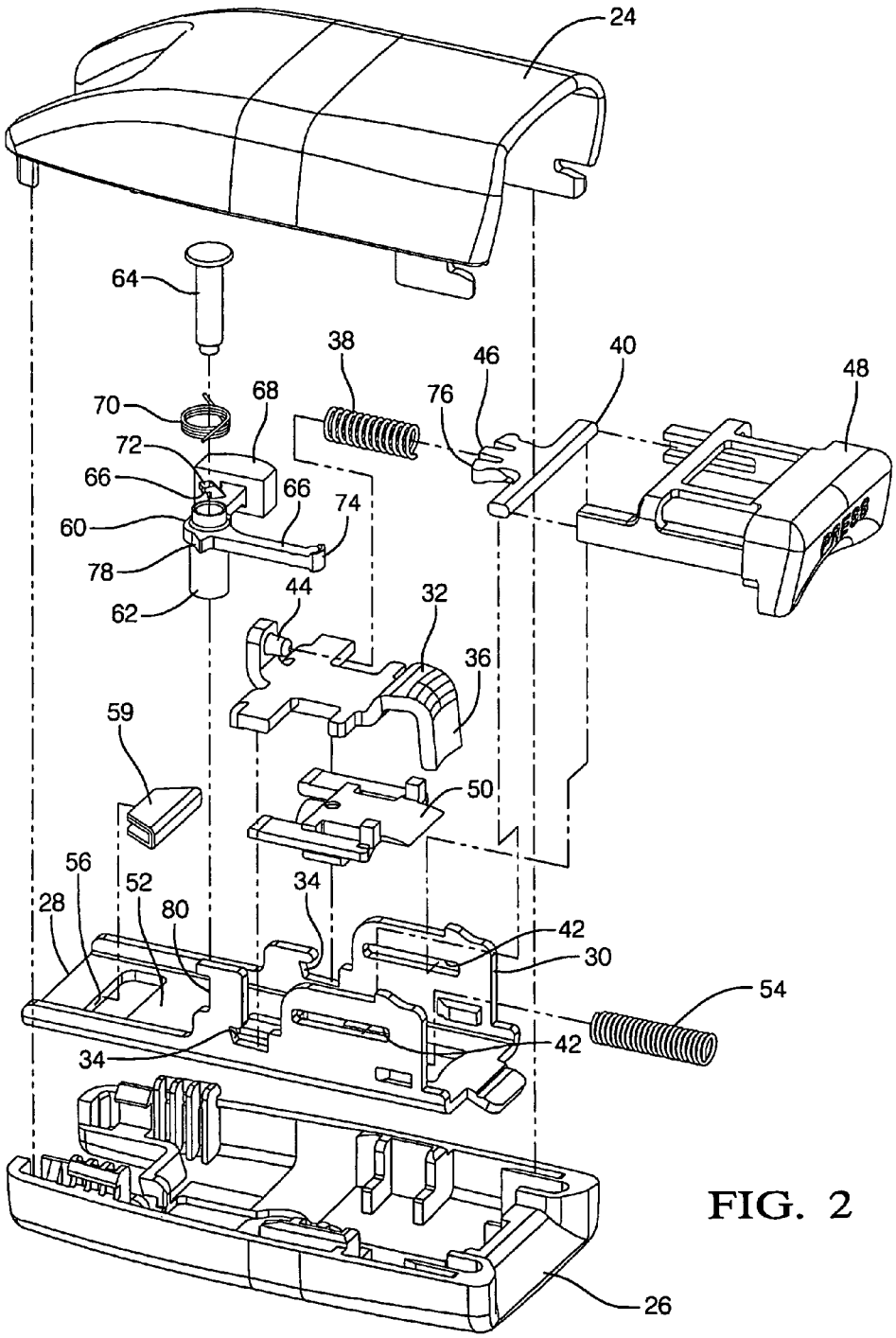
FIG. 2 is an exploded view of a seat belt buckle constructed in accordance with exemplary embodiments of the present invention.
Figure 3:
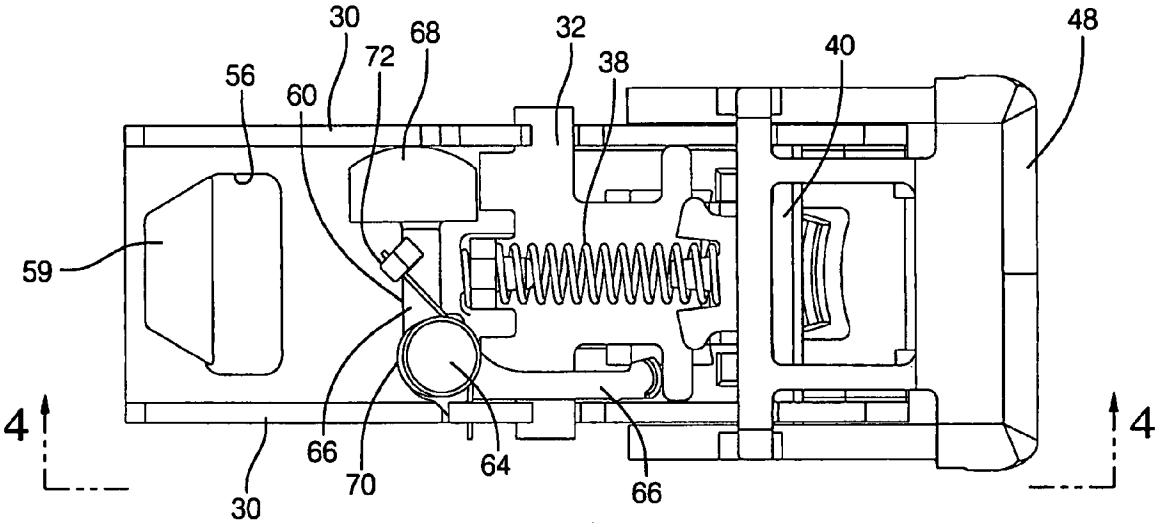
FIG. 3 is a top plan view of the inertia actuated locking mechanism of exemplary embodiments of the present invention.
Figure 4:
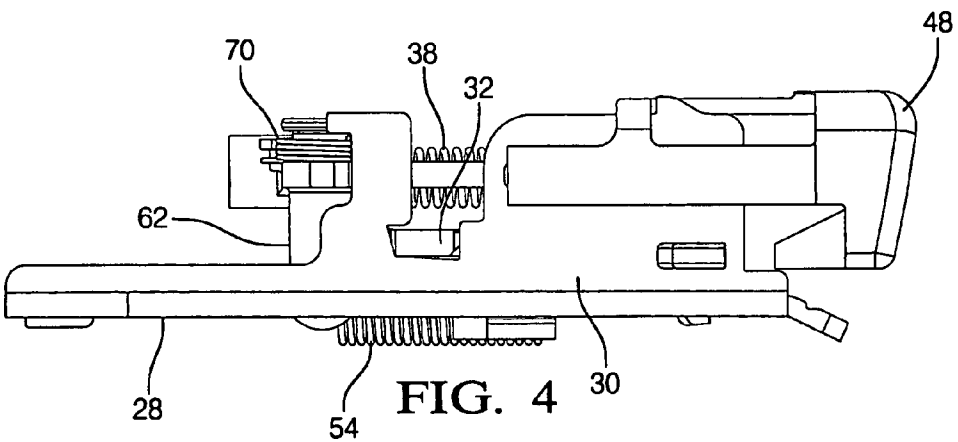
FIG. 4 is a view along the lines 4-4 of FIG. 3.
Figure 5:
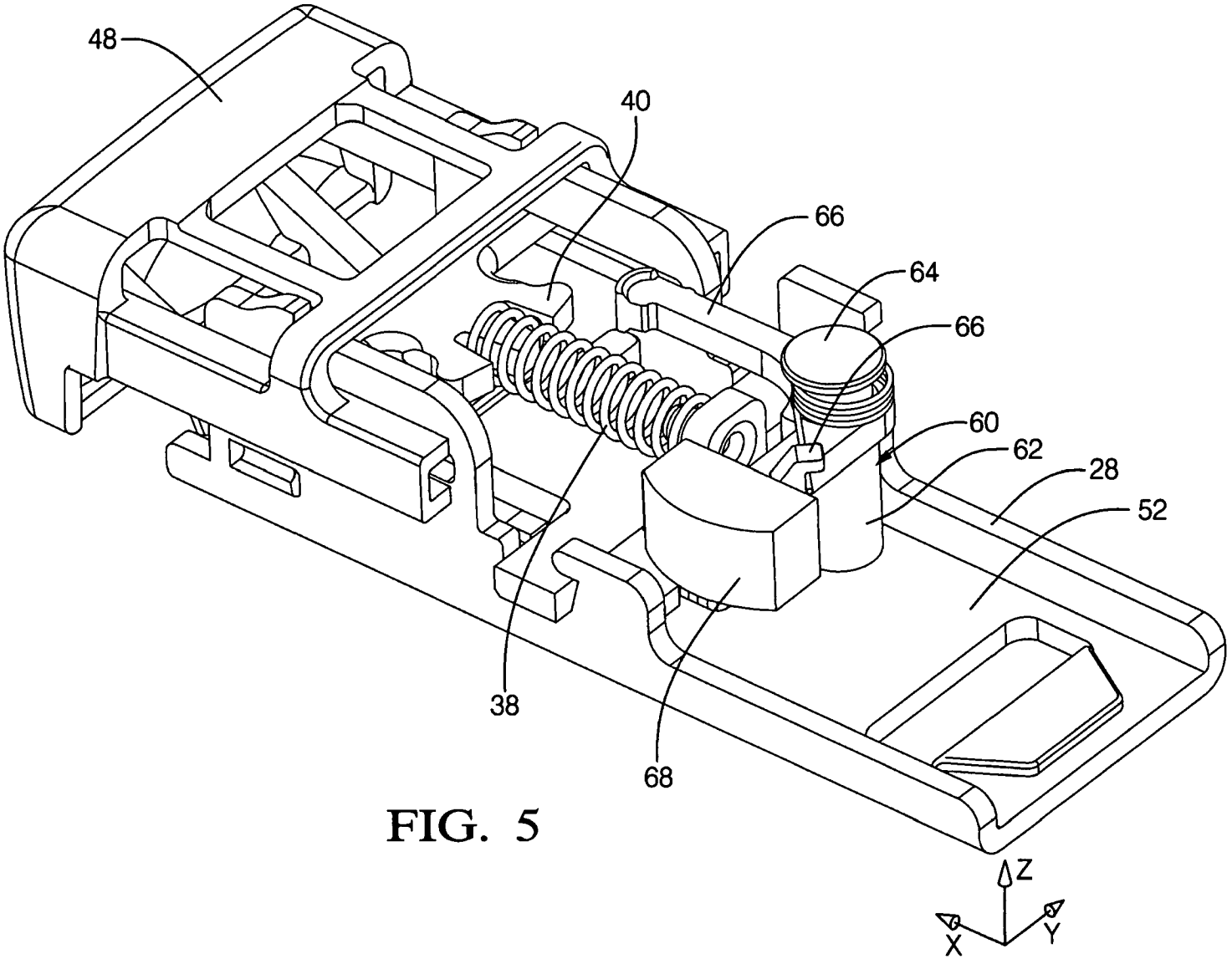
FIG. 5 is a perspective view of the inertia actuated locking mechanism of exemplary embodiments of the present invention.

Referring now to FIGS. 2-5, component parts of a seat belt buckle constructed in accordance with exemplary embodiments of the present invention is illustrated. FIG. 2 illustrates an exploded view of the seat belt buckle. As illustrated, seat belt buckle 10 comprises an upper housing portion 24 and a lower housing portion 26, received therein is a frame portion 28. Frame portion 28 comprises a pair of sidewalls 30, which are configured to rotatably receive and engage a latch 32. Latch 32 is configured to be received within a pair of openings 34 in sidewalls 30. Latch portion 32 further comprises a latching member 36 configured to engage opening 18 of tongue portion 12 as it is slid into belt buckle 10.

In order to rotate latch 32 into an unlocking position, a spring 38 is positioned between latch 32 and a release bar 40. Release bar 40 is slidably received within a pair of the elongated openings 42 disposed in sidewalls 30. Spring 38 is positioned upon a protrusion 44 of latch 32 and a protrusion 46 on release bar 40. Accordingly, and as release bar 40 is slid within elongated openings 42, spring 38 is compressed and an urging force is applied to latch 32. In order to slide release bar 40 within elongated openings 42, a release button 48 is configured to slidably engage sidewalls 30 while also providing a point of contact to release bar 40. Thus, as release button 48 is depressed, an urging force is applied to release bar 40 which will cause the same to slide within elongated openings 42.

In order to eject or provide an urging force to slide tongue portion 12 out of the belt buckle, an ejector 50 is slidably mounted to a lower surface 52 of frame portion 28. Ejector 50 is configured to make contact with a distal end of tongue portion 12 as the same is being inserted into opening 16 of belt buckle 10. Upon insertion of tongue portion 12 into belt buckle 10 ejector 50 is longitudinally slid with respect to frame portion 28 and accordingly a spring 54, which is disposed between frame portion 28 and ejector 50, is compressed as tongue portion 12 is slid into frame portion 28 wherein latch 32 is rotated into an engaging position such that tongue portion 12 is secured within belt buckle 10.

In operation, and upon application of a sliding force to release button 48, release bar 40 is slid within elongated openings 42 and spring 38 is compressed thereby urging latch 32 into an unlocking position wherein the spring force of spring 54 is released or urged upon ejector 50 in order to eject tongue portion 12 from seat belt buckle 10.

Frame portion 28 further comprises an opening 56 for receipt of webbing material 58 that operably connects seat belt buckle 10 to a retractor or anchor pre-tensioning mechanism 22. In addition, an edge protector 59 is inserted within opening 56 in order to provide a smooth contact surface for contact with webbing 58.

In order to provide undesired movement of the release bar 40 within elongated openings 42 (e.g., movement of release bar 40 that is not attributable to depression of release button 48 by an individual or other person who is using the seat belt secured thereto) an inertia locking device 60 is rotatably secured to frame portion 28. In exemplary embodiment, inertia locking device 60 comprises a cylinder or shaft portion 62 having an opening rotatably received about a portion of rivet or pin 64, which is secured to frame portion 28. The inertia locking device 60 further comprises a pair of arms 66 each of which depends away from shaft portion 62 of inertia locking device 60. At the end of one of the arms 66 is a mass 68. Mass 68 locates the center of gravity of inertia locking device 60 in a desired position as will be discussed herein. The inertia locking device 60 is biased into an unlocking position through the use of a torsional spring 70, or equivalent device for providing an urging force to inertia locking device 60. In accordance with an exemplary embodiment, one end of torsional spring 70 engages a feature 72 of inertia locking device 60 while the other end engages a portion of frame portion 28.

In an alternative embodiment pin 64 and inertia locking device 60 are directly mounted to a portion of latch 32.

Upon application of a force to belt buckle 10, which overcomes the biasing force of spring 70, inertia locking device 60 is rotated into a locking position wherein contact portion 74 is positioned to make contact with a contact portion 76 of release bar 40. Thus, and when belt buckle 10 is subjected to a force, which creates a moment in inertia locking device 60 that is greater and opposite in direction of the moment created by torsional spring 70, inertia locking device 60 is rotated into a locking position wherein contact portion 74 is located to prevent sliding movement of release bar 40 into a position that would cause latch 32 to disengage from tongue portion 12. It is also noted that release bar 40 is configured to have a pair of contact portions 76 disposed at either side of protrusion 46 thus, the installation of release bar 40 within elongated openings 42 is simplified as either contact portion 76 is appropriately placed to make contact with contact portion 74 of inertia locking device 60.

In order to define a limit of rotation or the locking position of inertia locking device 60, a feature 78 is positioned upon arm 66 such that feature 78 will engage an opening 80 disposed on sidewall 30 of frame portion 28.

Figure 8:
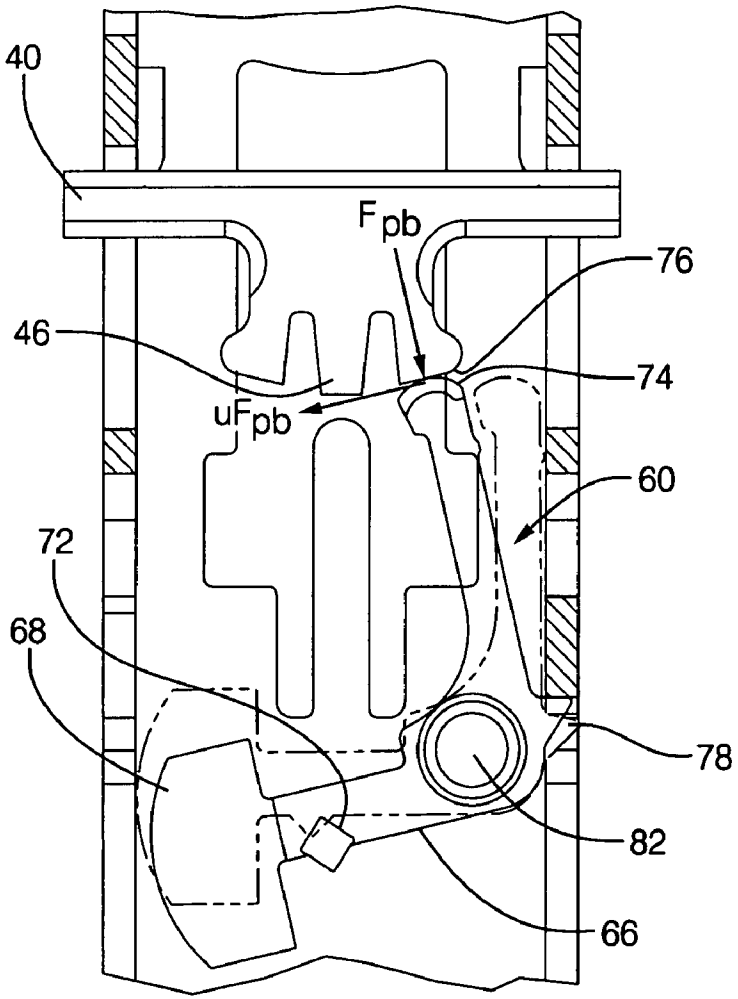
FIG. 8 is a top plan view illustrating movement of component parts of the inertia actuated locking mechanism of exemplary embodiments of the present invention.
Figure 7:
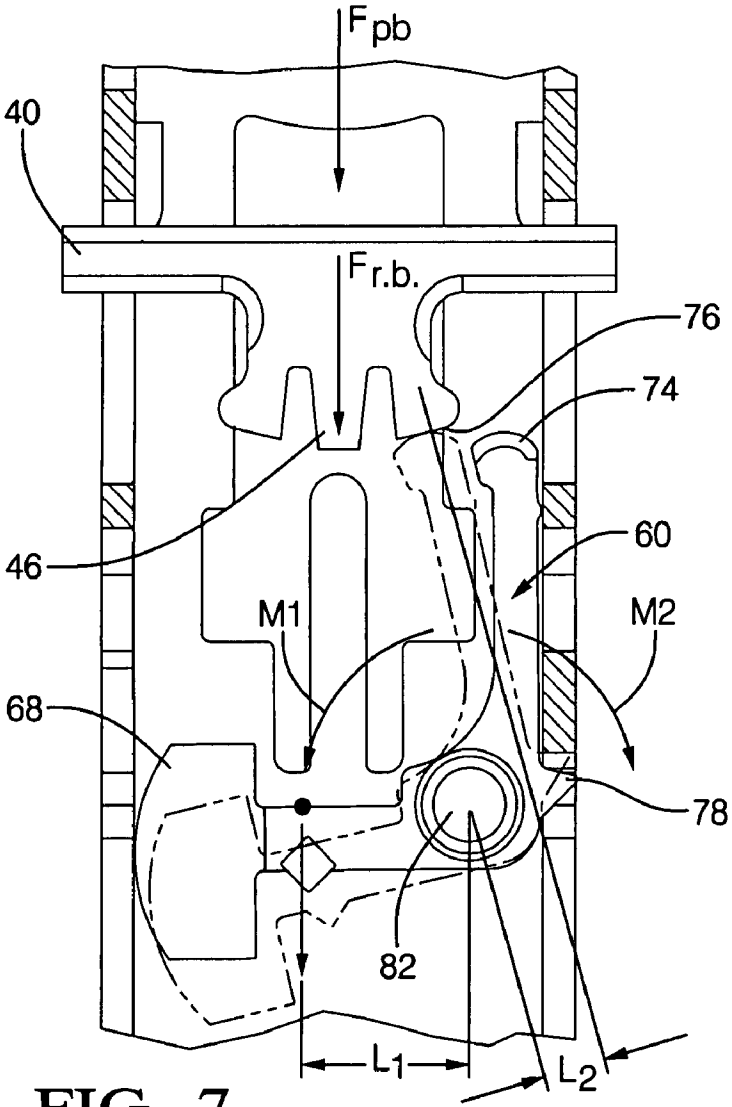
FIG. 7 is a top plan view illustrating component parts of the inertia actuated locking mechanism of exemplary embodiments of the present invention.
Figure 9D:
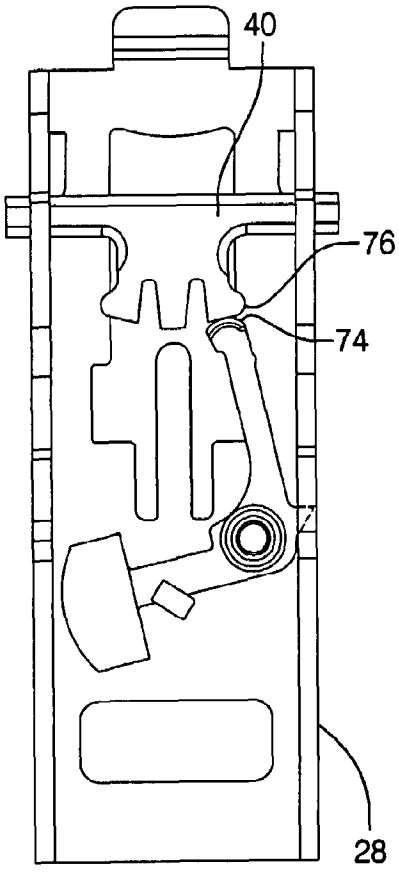
FIGS. 9A-9D are top plan views illustrating movement of component parts of the inertia actuated locking mechanism of exemplary embodiments of the present invention.
Figure 9C:
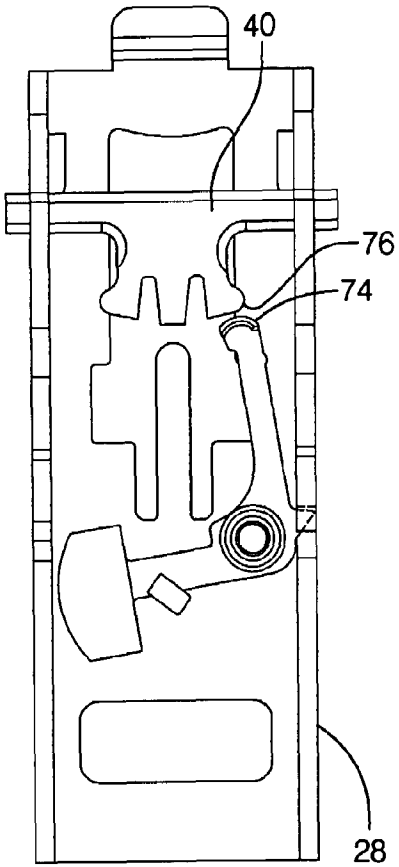
Figure 9B:
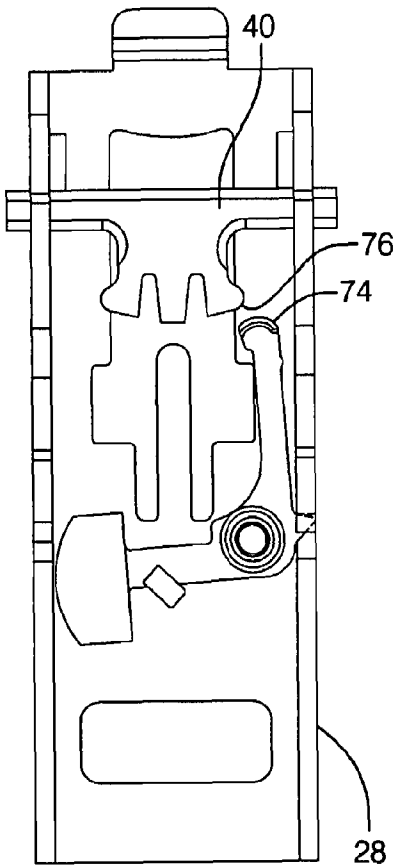
Figure 9A:
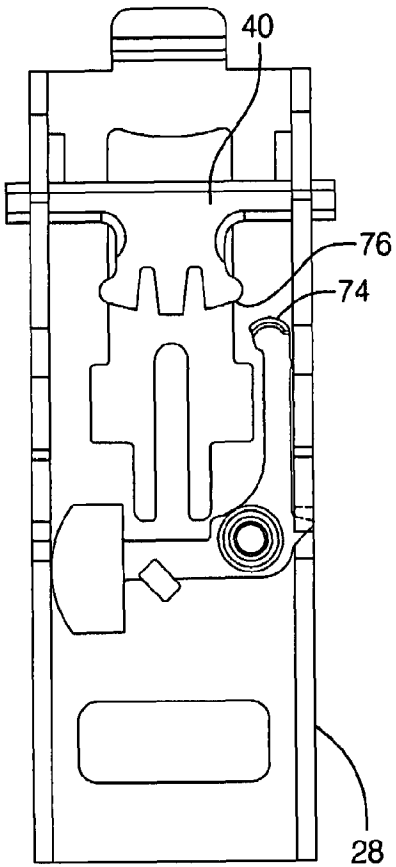

Referring now to FIGS. 7-9 operational aspects of release bar 40 and inertia locking device 60 are illustrated. As discussed above the seat belt webbing is connected to the tongue, which is inserted into the opening of the buckle assembly for latching. Upon insertion into the buckle assembly, the tongue contacts and depresses the ejector and stores energy in the ejector spring. As the ejector is depressed by the tongue it contacts the latch and rotates the latch through an aperture in the tongue. As the latch is rotated into the latched position the stored energy in the release bar spring translates the release bar in the elongated openings in the frame over the latch to hold the latch in a latched state.

When a seat belt pretensioner is activated the seat belt webbing attached to the tongue is pulled towards the pretensioner at a very high acceleration. Since the tongue described above is connected to the latch and subsequently the frame, the frame is displaced relative to the release button and the release bar and creates inertia forces on the release button and the release bar. The combined inertia forces of the release button and release bar may cause undesired movement.

During this same high acceleration event the inertia locking device 60 with a mass and center of gravity is located a specified distance from the pivotal securement of the same to the frame. The inertia forces acting on the inertia locking device 60 will rotate the inertia locking device 60 in a counterclockwise direction and block-out the translation of the release bar 40. Since the release button acts in conjunction with the release bar a latched state of the buckle is maintained by preventing translation of the release bar.

The operating principle of the block-out feature of the inertia locking device is illustrated in FIGS. 7-12. FIG. 7, illustrates how the design (e.g., configuration (size, weight, etc.) and location) of the inertia locking device is determined. Design of the inertia locking device is determined by determining the moments of the inertia locking device and the release bar and release button. In order to translate the inertia locking device into the locking position, the moment illustrated by arrow M1 is greater than the moment illustrated by M2. The moment M1 is equal to (mass of the arm 66 with mass 68)×(cg) where cg is the distance from the center of gravity of the arm with the mass to the arm pivot point 82. The Moment M2 is (the mass of the release button+the mass of the release bar)×(the contact distance to the arm pivot, which is represented as distance L2 in FIG. 7). The k factor of torsional spring 70 is also determined in order to return the inertia locking device to the unlocking position.

FIG. 8 illustrates how the configuration of contact portions 74 and 76 are determined. As illustrated, $F_{pb}$×(Dim. $L_1$)>$\mu F_{pb}$×(Dim. $L_2$) thus, when M1 is no longer being applied to the inertia locking device and in the event of the failure of torsional spring 70, inertia locking device 60 will translate out of the locking position.

For example, after a pretensioner has been deployed and in the event of a torsion spring 70 failure, the inertia locking device 60 is designed with positive back out or positive cam-out feature. If spring 70 fails the inertia locking device 60 will rotate into engagement with the release bar 40. When the pushbutton is depressed the release bar 40 will make contact with the inertia locking device 60. The point of contact between the release bar 40 and the inertia locking device 60 creates a line of force perpendicular to the contact surface of the release bar 40 and has a vector direction past the inertia locking device 60 pivot. This force vector about the inertia locking device 60 pivot is dimension $L_1$ (FIG. 7). The force vector creates a moment about the inertia locking device 60 pivot point. Thus, the cam moment is the equal to the release button force times dimension $L_1$.

Although, the dimensions $L_1$ and $L_2$ are listed as 2.63 mm and 22.46 mm respectively and the center of gravity is show as being 8.73 mm from the pivot point in the x direction and 8.96 mm from the pivot point along arm 66 as it is rotated into the locking position, it is understood that as applications vary these dimensions are not limiting and the same may be greater or less than those illustrated herein. Also, inertia locking device 60 is shown as translating or rotating 12.4 degrees from the unlocking position to the locking position. Again, and as applications may require the degrees of rotation may be greater or less than 12.4 degrees.

Referring now to FIGS. 9A-9D a sequential example of the travel of release bar 40 and inertia locking device 60 is illustrated. Referring back now to FIG. 5, and during activation of the pretensioner, the seat belt buckle experiences acceleration in all three axis x, y and z. Thus, the lock-out feature must therefore operate under accelerations in all three axes. The proposed design eliminates sensitivity to accelerations in two axis namely, y and z.

Sensitivity to acceleration in the z direction is eliminated by positioning the inertia locking device 60 pivot point 82, 90 degrees or perpendicular to the plane of the buckle base or surface 52 of frame 28 (z axis). Thus, sensitivity to accelerations in the z direction is eliminated. Sensitivity to accelerations in the y axis or y direction is eliminated by positioning the inertia locking device 60 mass 68 such that the resulting center of gravity (cg) is in line with and through the y axis of the pivot of the inertia locking device. As illustrated herein the inertia locking device is configured to rotate in directions parallel or substantially parallel to the mounting surface or surface of the frame to which the inertia locking device is rotatably mounted.

As discussed above and in an alternative embodiment pin 64 and inertia locking device 60 are directly mounted to a portion of latch 32 again here the rotational movement of the inertia locking device is configured to rotate in directions or in a plane parallel or substantially parallel to the mounting surface of the latch.

Rotations of the inertia locking device in the (x, z) and (z, y) planes are eliminated by positioning the inertia locking device 60 pivot point 82 such that only rotations in planes perpendicular or substantially perpendicular to the buckle base or surface 52 of frame 28 (x, y plane) are allowed. Thus, only rotation of the inertia locking device in the (x, y) plane are allowed while rotations in other planes are eliminated.

Figure 6:
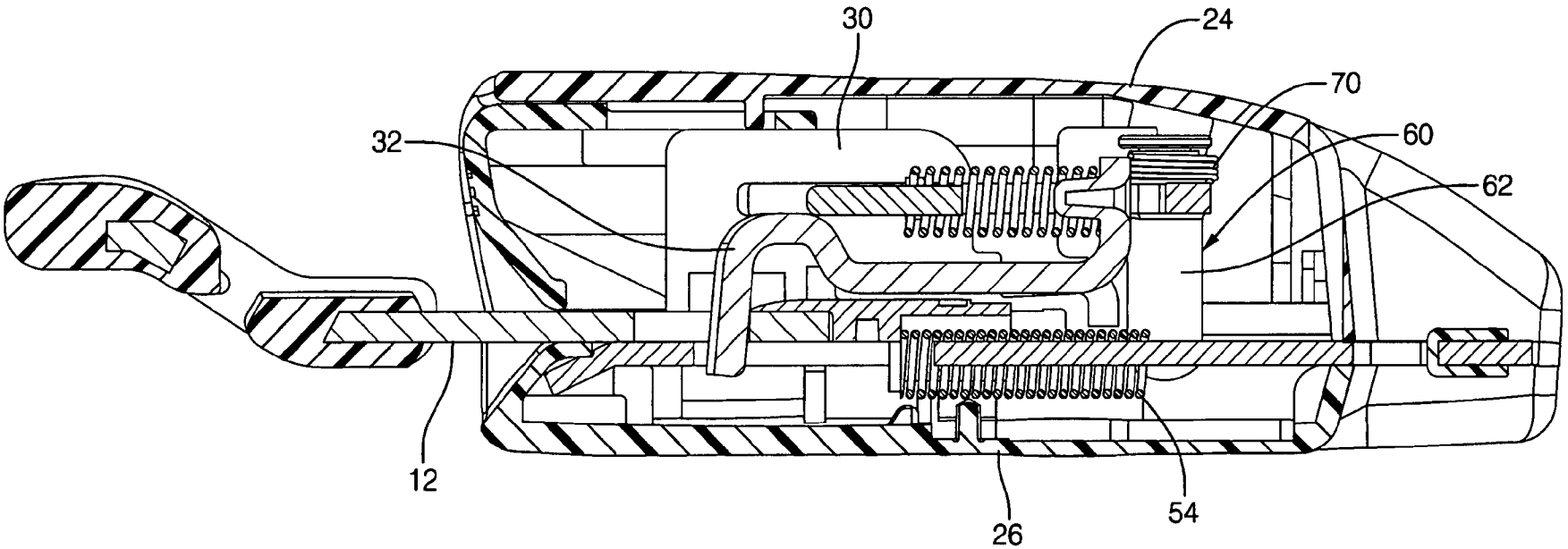
FIG. 6 is a cross-sectional view of the seat belt buckle of FIG. 1 engaged with a tongue portion of a seat belt.
Figure 10:
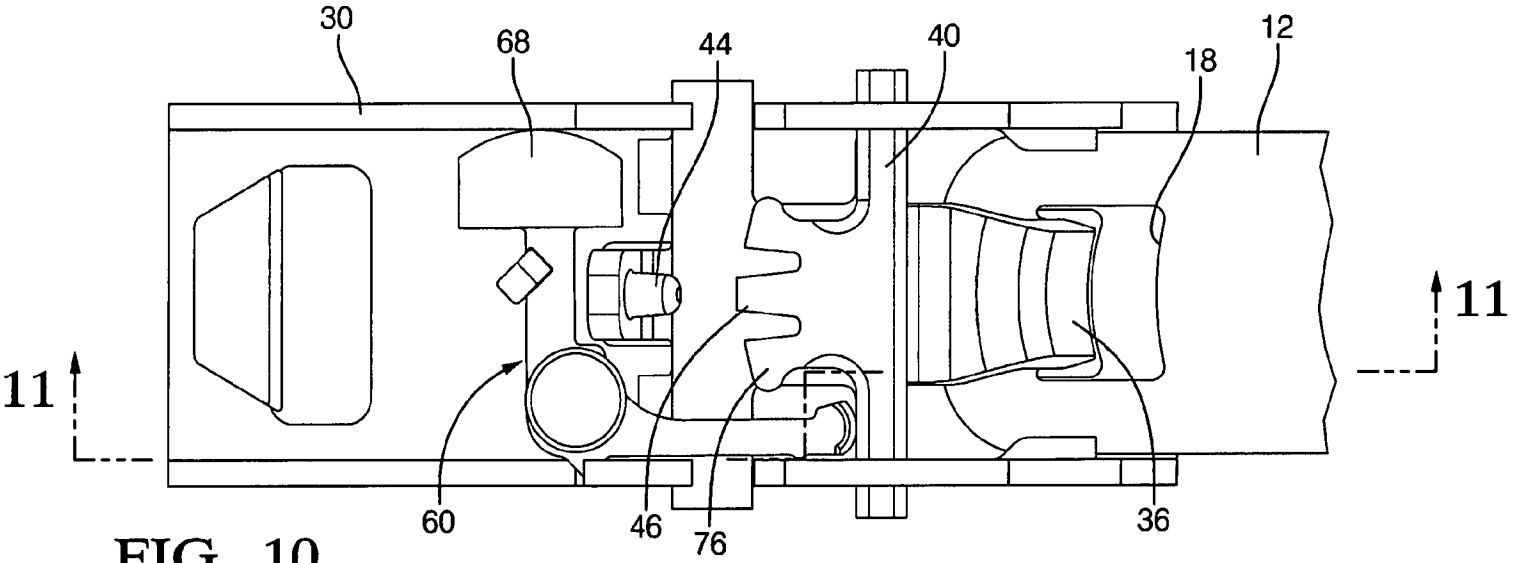
FIG. 10 is a top plan view of component parts of the seat belt buckle of exemplary embodiments of the present invention.
Figure 11:
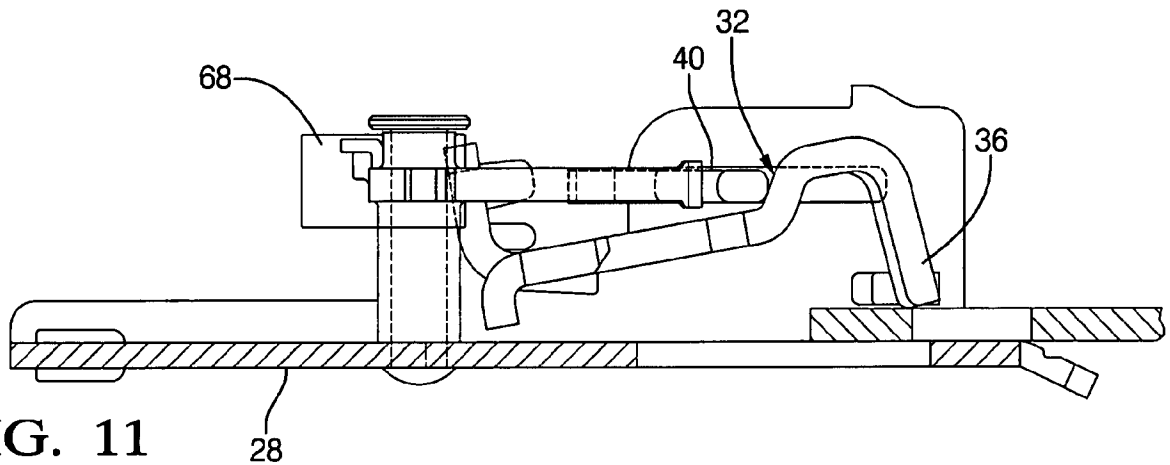
FIG. 11 is a view along lines 11-11 of FIG. 10.
Figure 12:
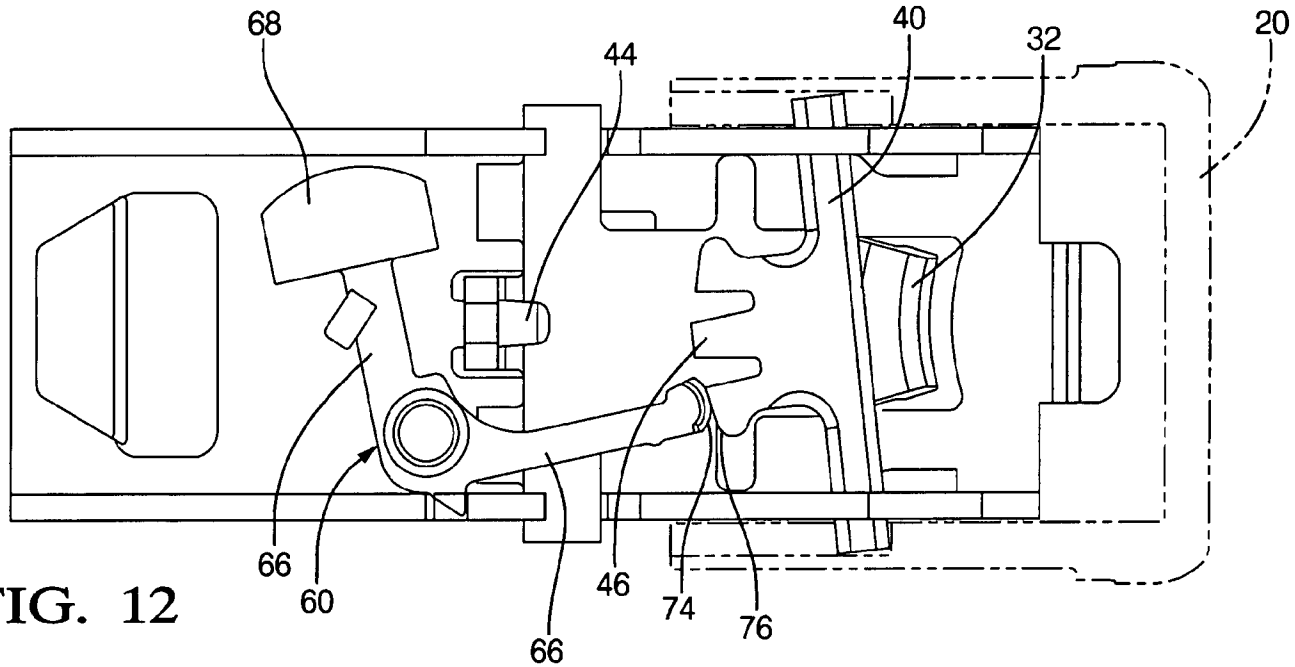
FIG. 12 is a view illustrating a maximum rotation of the release bar of the seat belt buckle of an exemplary embodiment of the present invention.
Figure 13:
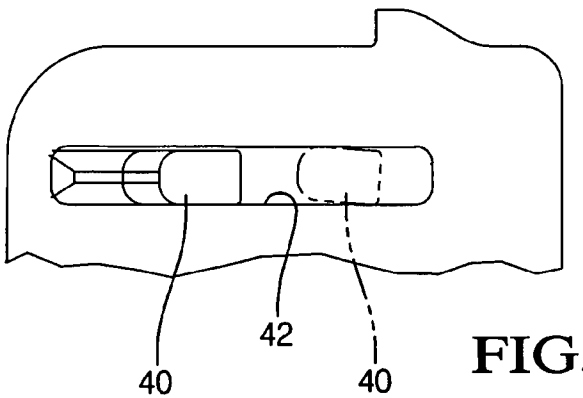
FIG. 13 is a side view illustrating possible movement of the release bar of the seat belt buckle of an exemplary embodiment of the present invention.

FIGS. 6, 10 and 11 illustrate the movement of latch 32 into a locking position (FIGS. 6 and 10) and an un-locking position FIG. 11. In accordance with an exemplary embodiment, FIGS. 12 and 13 illustrate the configuration of release bar 40, elongated openings 32 and maximum degrees of movement of release bar 40 within elongated openings 42. As illustrated in FIG. 12, the length of the elongated openings 42 and the width of the portions of release bar 40 slidably received therein are configured to limit or provide a maximum degrees of rotation of release bar 40 therein. The maximum degrees of rotation corresponds to one end portion of release bar making contact with an end of one of the elongated openings and the other end of the release bar making contact with an opposite end of the other elongated opening. As illustrated, in this configuration the maximum degrees of rotation is approximately 8.30 degrees. It is, of course, understood that as applications may vary and as the configuration of release bar 40 and elongated openings 42 changes this maximum degree of rotation may be greater or less than the aforementioned values.

FIG. 13 also illustrates the maximum rotation of release bar 40 within elongated openings 42 in a different plane. Here the maximum slot width is 2.7 mm and the minimum release bar thickness is 2.4 mm, and based upon the length of the portion of the release bar being slidably received within the elongated opening the maximum amount of rotation therein before the release bar make contact with the elongated opening is approximately 5.5 degrees. It is, of course, understood that this example is provided as a non-limiting example and as applications may vary and due to the configuration of the elongated openings 42 and release bar 40, the maximum amount of rotation may be greater or less than the aforementioned values.

Figure 14A:
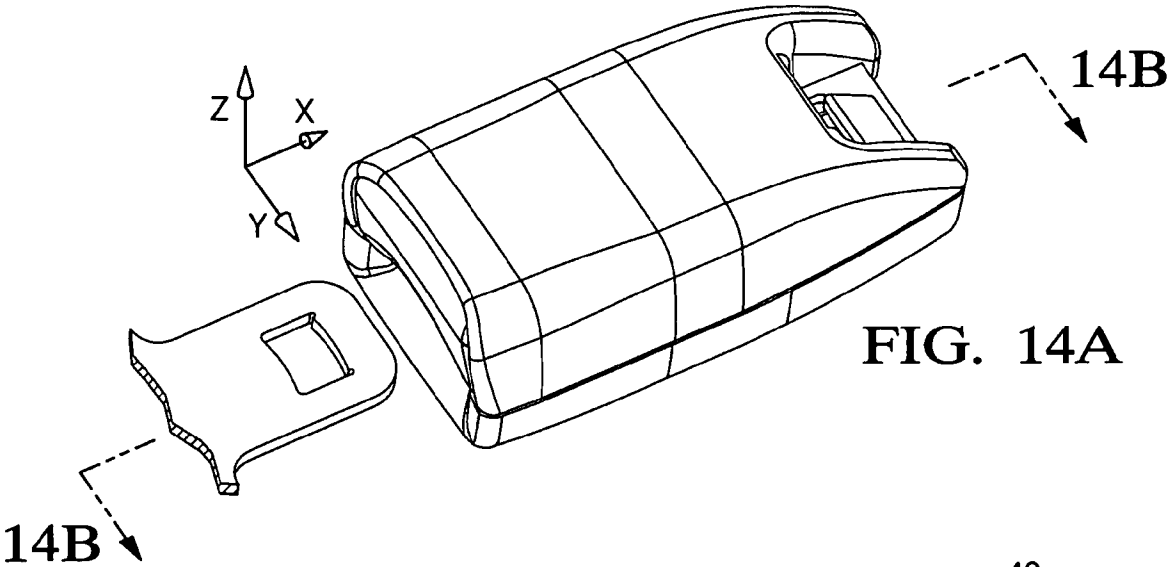
FIGS. 14A-14B illustrate an alternative exemplary embodiment of the present invention.
Figure 14B:
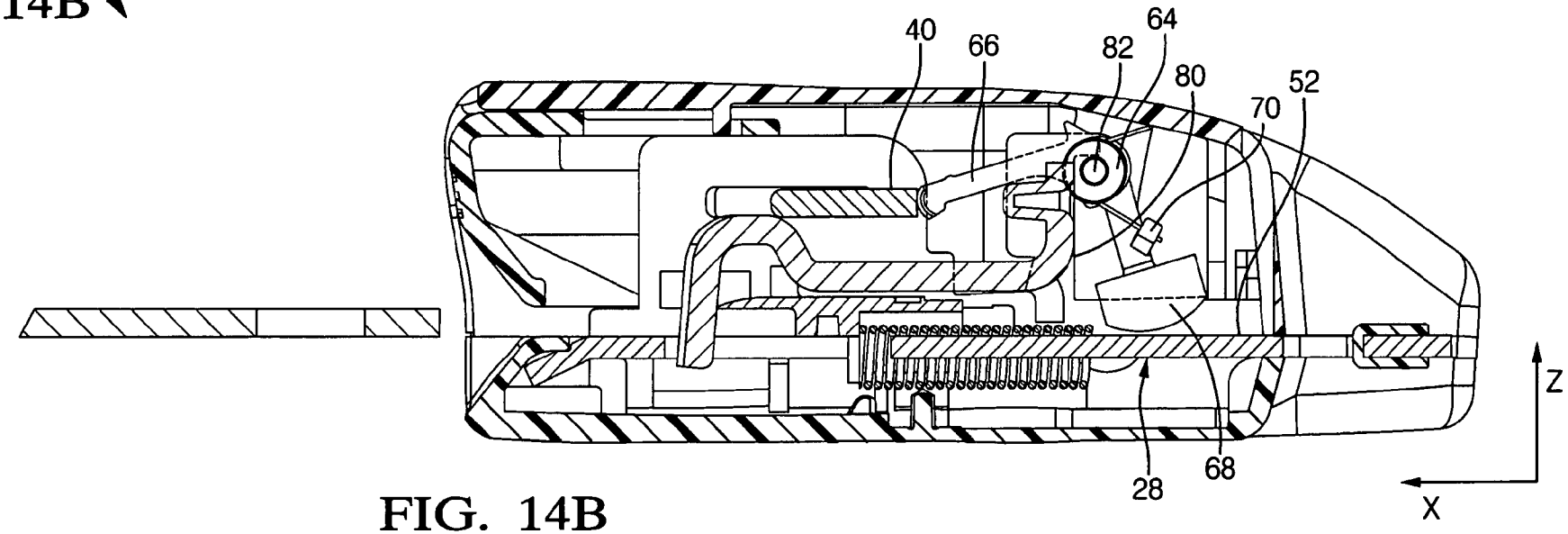

In yet another alternative embodiment and referring now to FIGS. 14A-14B, the inertia locking device is configured to rotate in directions or in a plane perpendicular or substantially perpendicular to the mounting surface of the inertia locking device. In this embodiment pin 64 is mounted to one of the sidewalls 30 or alternatively and as illustrated by the dashed lines in FIG. 14, pin 64 is mounted to a supporting member 80. In either configuration of the FIG. 14 embodiment, inertia locking device 60 is able to rotate in the directions of arrows 82 when the biasing force of the biasing spring 70 is overcome and when the biasing spring is able to bias the inertia locking device back into the unlocking position. Operational aspects of the buckle device are similar to those of the previous embodiments.

In yet another alternative embodiment, release bar 40 is captured or connected with the release button or the features of release bar 40 are captured or connected with portions of the release button 48 and inertia locking device 60 is configured, dimensioned and positioned to limit movement of release button 48.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A seat belt buckle for use with a tongue of a seat belt, the seat belt buckle comprising:

a frame portion;

a latch being movably mounted to said frame portion for movement between a first position and a second position, said latch being configured to engage a portion of the tongue as said latch moves from said first position to said second position;

a release bar being slidably mounted to said frame portion for movement between a locking position wherein the release bar engages the latch to maintain the latch in the second position, and a release position, wherein movement toward said release position causes an opening force to be applied to said latch in order to move said latch from said second position towards said first position, wherein movement of said release bar is effectuated by depression of a release button of said seat belt buckle; and an inertia locking device rotatably mounted to said frame portion for movement between a locking position and an unlocking position, said inertia locking device being configured for rotation in a plane substantially parallel to a point of securement of said inertia locking device to said frame, wherein said inertia locking device directly engages the release bar to prevent movement of said release bar into said release position when said inertia locking device is in said locking position, said inertia locking device being biased into said unlocking position by a biasing force and said inertia locking device rotates into said locking position when said seat belt buckle is subjected to a force that creates a moment in said locking device that is greater than said biasing force, wherein said inertia locking device further comprises a feature for engaging said frame to limit rotation of the inertia locking device into said locking position.

2. The seat belt buckle as in claim 1, wherein said inertia locking device comprises:

a pendulum having a pair of arms extending away from a point of rotatable securement to said frame portion;

a mass mounted to one of said pair of arms;

a contact point disposed at the other one of said pair of arms, said contact point being configured to engage a contact member of said release bar when said inertia locking device is rotated to said locking position; and a spring for biasing said inertia locking device into said unlocking position.

3. The seat belt buckle as in claim 2, wherein said inertia locking device further comprises:

a mounting portion secured to said pair of arms said mounting portion being rotatably received around a pivot pin secured to said frame portion, wherein said mounting portion is perpendicular to said frame portion.

4. The seat belt buckle as in claim 3, wherein said pair of arms are perpendicular to said mounting portion and the center of gravity of the one of said pair of arms with said mass is aligned with an axis perpendicular to said mounting portion and is parallel to a portion of said frame portion said mounting portion is mounted to.

5. The seat belt buckle as in claim 1, wherein said inertia locking device is not affected by accelerations of said seat belt buckle in at least one direction perpendicular to said frame portion and at least one direction parallel to said frame portion.

6. The seat belt buckle as in claim 5, wherein said release button movably is mounted to said frame and said release button is configured to slide said release bar to said release position as said release button is moved with respect to said frame.

7. The seat belt buckle as in claim 1, wherein said frame further comprises and opening, and wherein said feature is received within said opening, said feature limiting the rotation of said pendulum away from said unlocking position, said limit of rotation away from said unlocking position defining said locking position.

8. The seat belt buckle as in claim 7, wherein said release button is movably mounted to said frame and said release button is configured to slide said release bar to said release position as said release button is moved with respect to said frame.

9. The seat belt buckle as in claim 2, wherein said contact point is configured to allow said release bar to rotate said inertia locking device back into said unlocking position as said release bar is slid to said release position in absence of said force.

10. The seat belt buckle as in claim 9, further comprising a latch spring disposed between said release bar and said latch, said latch spring being compressed and providing said opening force to said latch as said release bar is moved to said release position.

11. The seat belt buckle as in claim 10, wherein one end of said spring is received on a first protrusion of said release bar and another end of said spring is received on a second protrusion of said latch.

12. The seat belt buckle as in claim 11, wherein a pair of engaging members are disposed about said first protrusion, wherein one of said pair of engaging members makes contact with said point of contact when said inertia locking device is rotated to said locking position and said release bar is slid to said release position.

13. The seat belt buckle as in claim 12, wherein said release bar is mounted within a pair of slotted openings of said frame.

14. The seat belt buckle as in claim 1, wherein said release button is movably mounted to said frame and said release button is configured to slide said release bar to said release position as said release button is moved with respect to said frame.

15. The seat belt buckle as in claim 1, wherein said frame portion is configured to be anchored to a vehicle.

16. A locking mechanism for use with a seat belt having a tongue member configured for latching with the seat belt buckle, the locking mechanism comprising:

a frame portion;

a latch being movably mounted to said frame portion for movement between a first position and a second position, said latch being configured to engage a portion of the tongue member as said latch moves from said first position to said second position;

a release bar being slidably mounted to said frame portion for movement between a locking position wherein the release bar engages the latch to maintain the latch in the second position, and a release position, wherein movement toward said release position causes an opening force to be applied to said latch in order to move said latch from said second position towards said first position, wherein movement of said release bar is effectuated by depression of a release button of the seat belt buckle; and an inertia locking device rotatably mounted to said frame portion for movement between a locking position and an unlocking position, wherein said inertia locking device directly engages the release bar and is rotatable to prevent movement of said release bar into said release position when said inertia locking device is in said locking position, said inertia locking device being biased into said unlocking position by a biasing force and said inertia locking device rotates into said locking position when said seat belt buckle is subjected to a force that creates a moment in said locking device that is greater than said biasing force, wherein said inertia locking device further comprises a feature for engaging said frame to limit rotation of the inertia locking device into said locking position.

17. The locking mechanism as in claim 16, wherein said inertia locking device comprises:

a pendulum having a pair of arms extending away from a point of rotatable securement to said frame;

a mass mounted to one of said pair of arms;

a contact point disposed at the other one of said pair of arms, said contact point being configured to engage a contact member of said release bar when said inertia locking device is rotated to said locking position; and a spring for biasing said inertia locking device into said unlocking position.

18. The locking mechanism as in claim 17, wherein a center of gravity of the one of said pair of arms with said mass is in line with an axis perpendicular to said point of rotatable securement and said inertia locking and parallel to a portion of said frame portion said frame portion is rotatably secured to.

19. The locking mechanism as in claim 18, wherein said contact point is configured to allow said release bar to rotate said inertia locking device back into said unlocking position as said release bar is slid to said release position in absence of said force.

20. The seat belt buckle as in claim 19, further comprising a latch spring disposed between said release bar and said latch, said latch spring being compressed and providing said opening force to said latch as said release bar is moved to said release position.

21. The seat belt buckle as in claim 19, wherein one end of said latch spring is received on a first protrusion of said release bar and another end of said latch spring is received on a second protrusion of said latch.

22. The seat belt buckle as in claim 21, wherein a pair of engaging members are disposed about said first protrusion, wherein one of said pair of engaging members makes contact with said point of contact when said inertia locking device is rotated to said locking position and said release bar is slid to said release position.

23. The locking mechanism as in claim 16, wherein said frame further comprises and opening, and wherein said feature is received within said opening, said feature limiting the rotation of said pendulum away from said unlocking position, said limit of rotation away from said unlocking position defining said locking position.

24. A restraint system for a vehicle, comprising:

a seat belt buckle for use with a tongue of a seat belt, the seat belt buckle comprising:

a frame portion;

a latch being movably mounted to said frame portion for movement between a first position and a second position, said latch being configured to engage a portion of the tongue as said latch moves from said first position to said second position;

a release bar being slidably mounted to said frame portion for movement between a locking position wherein the release bar engages the latch to maintain the latch in the second position, and a release position, wherein movement toward said release position causes an opening force to be applied to said latch in order to move said latch from said second position towards said first position, wherein movement of said release bar is effectuated by depression of a release button of said seat belt buckle; and an inertia locking device rotatably mounted to said frame portion for movement between a locking position and an unlocking position, wherein said inertia locking device directly engages the release bar to prevent movement of said release bar into said release position when said inertia locking device is in said locking position, said inertia locking device being biased into said unlocking position by a biasing force and said inertia locking device rotates into said locking position when said seat belt buckle is subjected to a force that creates a moment in said locking device that is greater than said biasing force, wherein said inertia locking device further comprises a feature for engaging said frame to limit rotation of the inertia locking device into said locking position; and a pre-tensioning device for removing slack from said seat belt in accordance with a predetermined event.

25. The restraint system as in claim 24, wherein said inertia locking device is not affected by accelerations of said seat belt buckle in at least one direction perpendicular to said frame portion and at least one direction parallel to said frame portion.

26. The restraint system as in claim 24, wherein said inertia locking device comprises:

a pendulum having a pair of arms extending away from a point of rotatable securement to said frame;

a mass mounted to one of said pair of arms;

a contact point disposed at the other one of said pair of arms, said contact point being configured to engage a contact member of said release bar when said inertia locking device is rotated to said locking position; and a spring for biasing said inertia locking device into said unlocking position.

27. The restraint system as in claim 26, wherein said inertia locking device further comprises:

a mounting portion secured to said pair of arms said mounting portion being rotatably received around a pivot pin secured to said frame portion, wherein said mounting portion is perpendicular to said frame portion and said pair of arms are perpendicular to said mounting portion and the center of gravity of the one of said pair of arms with said mass is aligned with an axis perpendicular to said mounting portion and is parallel to a portion of said frame portion said mounting portion is mounted to.

28. The restraint system as in claim 24, wherein said frame further comprises and opening, and wherein said feature is received within said opening, said feature limiting the rotation of said pendulum away from said unlocking position, said limit of rotation away from said unlocking position defining said locking position.

29. A seat belt buckle for use with a tongue of a seat belt, the seat belt buckle comprising:

a frame portion;

a latch being movably mounted to said frame portion for movement between a first position and a second position, said latch being configured to engage a portion of the tongue as said latch moves from said first position to said second position;

a release bar being slidably mounted to said frame portion for movement in a plane between a locking position wherein the release bar engages the latch to maintain the latch in the second position, and a release position, wherein movement toward said release position causes an opening force to be applied to said latch in order to move said latch from said second position towards said first position; and an inertia locking device rotatably mounted to said frame portion for movement between a locking position and an unlocking position, wherein said inertia locking device directly engages the release bar to prevent movement of said release bar into said release position when said inertia locking device is in said locking position, said inertia locking device being biased into said unlocking position by a biasing force and said inertia locking device rotates parallel to said plane into said locking position when said seat belt buckle is subjected to a force that creates a moment in said locking device that is greater than said biasing force, wherein said inertia locking device comprises:

a pendulum having a pair of arms extending away from a point of rotatable securement to said frame portion, said pendulum comprising a feature received in an opening in said frame for engaging said frame to limit rotation of the pendulum away from the unlocking position, said limit of rotation away from said unlocking position defining said locking position;

a mass mounted to one of said pair of arms;

a contact point disposed at the other one of said pair of arms, said contact point being configured to engage a contact member of said release bar when said inertia locking device is rotated to said locking position;

a spring for biasing said inertia locking device into said unlocking position; and a mounting portion secured to said pair of arms said mounting portion being rotatably received around a pivot pin secured to said frame portion, wherein said mounting portion is parallel to or substantially parallel to said frame portion.

30. The seat belt buckle as in claim 29, wherein said pair of arms are perpendicular to said mounting portion and the center of gravity of the one of said pair of arms with said mass is aligned with an axis perpendicular to said mounting portion and is perpendicular to a portion of said frame portion said mounting portion is mounted to.

31. The seat belt buckle as in claim 30, wherein said inertia locking device rotates only in directions perpendicular to said frame portion.

32. The seat belt buckle as in claim 29, wherein said contact point is configured to allow said release bar to rotate said inertia locking device back into said unlocking position as said release bar is slid to said release position in absence of said force.

33. The seat belt buckle as in claim 29, wherein said inertia locking device is rotatably mounted to a side wall of said frame portion.

34. A seat belt buckle for use with a tongue of a seat belt, the seat belt buckle comprising:

a frame portion;

a latch being movably mounted to said frame portion for movement between a first position and a second position, said latch being configured to engage a portion of the tongue as said latch moves from said first position to said second position;

a release bar being slidably mounted to said frame portion for movement between a locking position wherein the release bar engages the latch to maintain the latch in the second position, and a release position, wherein movement toward said release position causes an opening force to be applied to said latch in order to move said latch from said second position towards said first position; and an inertia locking device rotatably mounted to said latch for movement between a locking position and an unlocking position, wherein said inertia locking device directly engages the release bar to prevent movement of said release bar into said release position when said inertia locking device is in said locking position, said inertia locking device being biased into said unlocking position by a biasing force and said inertia locking device rotates into said locking position when said seat belt buckle is subjected to a force that creates a moment in said locking device that is greater than said biasing force, wherein said inertia locking device further comprises a feature for engaging said frame to limit rotation of the inertia locking device into said locking position.

* * * * *